US006564710B1

(12) United States Patent
Mathea

(10) Patent No.: US 6,564,710 B1
(45) Date of Patent: May 20, 2003

(54) APPARATUS FOR IMPRINTING AN UNMARKED FOIL

(75) Inventor: Hans Mathea, Eggenstein-Leopoldshafen (DE)

(73) Assignee: CSAT Gesellschaft für Computer Systeme und Automations-Technik mit beschränkter Haftung, Eggenstein-Leopoldshafen (DE)

( * ) Notice: Subject to any disclaimer, the term of this patent is extended or adjusted under 35 U.S.C. 154(b) by 0 days.

(21) Appl. No.: 09/431,572

(22) Filed: Oct. 29, 1999

(30) Foreign Application Priority Data

Oct. 31, 1998 (DE) ..... 198 50 274

(51) Int. Cl.[7] ..... B41F 13/56
(52) U.S. Cl. ..... 101/227; 101/226
(58) Field of Search ..... 101/227, 226, 101/228, 219, 242, 232, 234, 216, 212

(56) References Cited

U.S. PATENT DOCUMENTS 4,569,285 A * 2/1986 Forno et al. ..... 101/232
4,985,096 A * 1/1991 Bekker-Madsen ..... 156/64
5,269,222 A * 12/1993 Johnson et al. ..... 101/228
5,379,697 A * 1/1995 Ertl ..... 101/424.1
5,479,855 A * 1/1996 Christoph et al. ..... 101/174
5,483,893 A * 1/1996 Isaac et al. ..... 101/226
5,711,225 A * 1/1998 Rasmussen ..... 101/228
5,964,151 A * 10/1999 Mathea ..... 101/227

FOREIGN PATENT DOCUMENTS

EP 0223405 * 5/1987 ..... 101/227

* cited by examiner

*Primary Examiner*—Anthony H. Nguyen
(74) *Attorney, Agent, or Firm*—Klaus J. Bach

(57) ABSTRACT

In an apparatus for imprinting an unmarked foil with images which are to be arranged within sections of the foil of a predetermined length L, including a printing device, a foil section transport device for moving the foil stepwise in sections of the length L, a cutting device for cutting the foil into the sections and a foil buffer arrangement accommodating a varying length of the foil between the printing device and the transport device, a foil motion sensor is arranged at the exit of the buffer arrangement for sensing the foil movement out of the buffer arrangement and controlling accordingly the speed of the printing device and a foil length sensor is arranged in the buffer arrangement and providing a print initiation signal when the foil length between the end of the foil in the cutting device and the printing device is a predetermined multiple of the foil section length L.

6 Claims, 1 Drawing Sheet

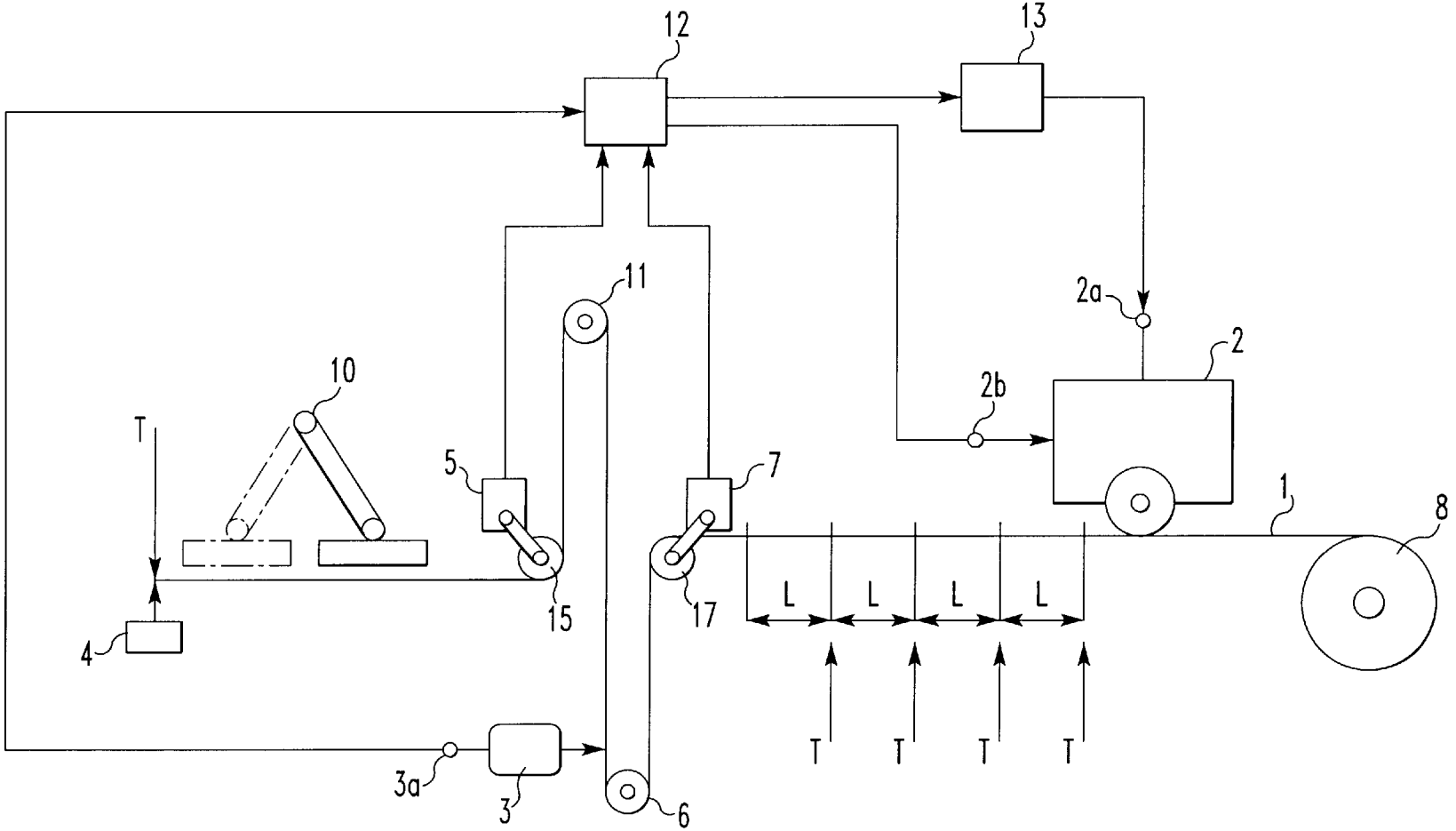
8
1
2
2a
2b
13
12
7
17
6
11
15
5
3
3a
10
4
L
L
L
L
T
T
T
T
T

APPARATUS FOR IMPRINTING AN UNMARKED FOIL

BACKGROUND OF THE INVENTION

The invention resides in an apparatus for imprinting an unmarked foil with images which are to be disposed within sections of the foil of a predetermined length. The apparatus includes a printing device through which the foil is continuously moved and, after being imprinted, the foil is moved to a transport device in which the foil is advanced in steps of the predetermined length at a time. A sensor generates a printing device activation signal when the length of the foil between a section limit of the foil in the transport device and the printer is a predetermined multiple of the predetermined section length so as to cause the image to be printed properly within a section of the foil. A foil buffer arrangement is disposed between the printing device and the transport device.

Such an apparatus is known for example from Applicant's U.S. Pat. No. 5,964,151 issued Oct. 12, 1999. The apparatus described therein is used preferably for blister packs having pockets including particular pills wherein the images must be accurately disposed on the pockets.

The pills are disposed in the pockets of blister foils of plastic or paper, which are sealed by a cover foil. The imprint on the cover includes data concerning the pills in the various pockets, for example, instructions as to the use of the individual pills. It is therefore very important that the data are properly located with respect to the location of the pills, that is, on the cover foil on top of the proper pockets. Any mismatch between the cover foil and the blister foil must therefore be minimal, that is, the information should be accurately disposed on the respective pockets which include the pills to which the information applies.

With the known apparatus, the cover foil can be applied to the blister foil with high accuracy. This is achieved essentially by the fact that the beginning of a foil section to be imprinted is constantly re-determined. By the constant re-determination of the beginning of the section to be imprinted, errors are not added up. As a result, even relatively large deviations are generally not detrimental since a deviation on one section does not affect the positioning of the imprint on the next section. Also, slippage of the foil does not affect the following image positions.

The known apparatus is particularly advantageous if the sections are removed from the apparatus in a discontinuous manner, since the signal activating the printing device to imprint a single image is generated for each imprint by a sensor when a compensation roller in a foil buffer loop is disposed in a predetermined position. With the stepwise removal of the imprinted foil sections, the compensating roller moves back and forth over a certain distance along a given path, that is, its position changes depending on the length of the foil between the printing device and the section removal device. Consequently, the compensation roller is very suitable for generating a foil length dependent signal.

For controlling the speed of the printing device the prior apparatus includes a ramp-like proximity sensor, which is arranged adjacent the path of movement of the compensating roller. The proximity sensor is so designed or so arranged that the distance of the compensating roller from the proximity sensor changes continuously with the movement of the compensating roller over an active range. In this way, the proximity sensor generates a signal, which depends on the position of the compensating roller that is on the distance of the compensating roller from the ramp of the proximity sensor. This signal is used for controlling the speed of the printing device.

With the stepwise removal of the foil from the known apparatus, the compensation roller is in constant motion so that the output signal of the sensor changes constantly.

In order to prevent the drive of the printing device from constantly changing its speed in accordance with the output signal of the sensor, an average value of the sensor output signal is formed in the known apparatus. It is not indicated in the prior art patent how such an average value is formed.

In practice, the sensor output signal is averaged by making the drive for the printing device relatively insensitive to signal changes. Then the speed of the printing device does not follow directly the sensor signal, but the drive for the printing device is still subjected to relatively large speed changes, which detrimentally affects the operation of the apparatus.

It is the object of the present invention to provide an apparatus like Applicant's earlier apparatus wherein, however, the drive for the printing devices operates at a relatively constant speed.

SUMMARY OF THE INVENTION

In an apparatus for imprinting an unmarked foil with images which are to be arranged within sections of the foil of a predetermined length L, including a printing device, a foil section transport device for moving the foil stepwise in sections of the length L, a cutting device for cutting the foil into the sections and a foil buffer arrangement accommodating a varying length of the foil between the printing device and the transport device, a foil motion sensor is arranged at the exit of the buffer arrangement for sensing the foil movement out of the buffer arrangement and controlling accordingly the speed of the printing device and a foil length sensor is arranged in the buffer arrangement and providing a print initiation signal when the foil length between the end of the foil in the cutting device and the printing device is a predetermined multiple of the foil section length L.

With the movement sensor at the exit of the buffer arrangement, the average speed at which the foil sections are removed can be determined in a separate control unit in a simple manner and very accurately. If the speed at which the foil is moved through the printing device corresponds to the determined average speed, the same length of foil is supplied to the buffer arrangement as is removed therefrom on the average, although in a stepwise fashion. The length of the foil in the buffer arrangement varies therefore around a certain average value. The constant speed with which the foil is moved through the printing device has a highly positive effect on the image quality and the positioning of the print image on the foil. Furthermore, the constant drive speed makes the printing device more reliable. In addition, the life expectancy of the printing device is greatly increased.

In a particular embodiment of the invention, the buffer arrangement includes a compensating roller which is movably so arranged that its position depends on the length of the foil between a section limit determined with the last sectioning step and the printing device. A sensor is provided which detects the position of the compensating roller. The compensating roller is disposed in a loop of the foil so that the foil extends around the compensating roller. If the length of the foil in the buffer arrangement becomes smaller, the compensating roller is moved in the direction of the opening of the loop. If the length of the foil in the buffer arrangement becomes greater, the compensating roller moves away from the open end of the loop so that the loop becomes elongated taking up the increased length of the foil in the buffer arrangement.

With the compensation roller, the buffer arrangement is provided in a simple manner. In addition, the compensation roller forms an element by way of which the length of the foil in the buffer arrangement can be determined in a simple manner. The compensation roller position sensor is preferably an optical sensor and is so arranged that it is disposed in the center of the back and forth movement path of the compensation roller so that the compensation roller passes by the sensor with the same amplitude in both directions.

In another embodiment of the invention, there is provided an offset roller by way of which the length of the endless foil between the respective last sectioning limit and the printing device, and consequently the position of the compensation roller, can be changed. This is then advantageous when the format of the printing image or the size of the section to be imprinted is changed since, in that case, the length of the foil between last section limit and the printing device has to be changed. In order to leave the average position of the compensating roller unchanged inspite of the change of length of the foil in the buffer arrangement, the offset roller is moved to a position wherein the length of the foil between the last section limit and the printing device is again a predetermined multiple of the now changed, that is a second predetermined length L of a foil section, when the compensation roller is disposed adjacent the sensor. In this way, it is not necessary to change the position of the printing device when the length of the foil section is changed.

It has been found to be advantageous if a foil motion sensor, which is preferably a roller rotation sensor is disposed at the entrance to the buffer arrangement. This motion sensor determines the length of the foil and the speed of the foil leaving the printing device and entering the buffer arrangement. Its signal is used for maintaining the speed with which the foil is moved through the printing device constant.

Since the speed with which the foil enters the buffer arrangement corresponds to the speed with which the foil moves through the printing device, the output signal of the foil motion sensor is representative of the speed with which the foil moves through the printing device. If this signal deviates from a foil motion signal provided by a motion sensor sensing the motion of the foil leaving the buffer arrangement or from a desired value provided by a control unit, the operating speed of the printing unit is changed accordingly in a well known manner. The control of the speed of the printing device positively affects the image quality and the accuracy of the printing operation.

With the second foil motion sensor, it is furthermore possible to determine the difference in foil length of the foil entering the buffer arrangement and that leaving the buffer arrangement. A computer in the control unit forms the difference of the signals provided by the first and second foil motion sensors. This signal can be utilized advantageously for a correction of the activation of the printing step as it is in fact used in another embodiment of the invention.

With the correction of the activation of the printing step, the printing process can be started at a point different from the occurrence of the signal provided by the compensation roller position sensor. This permits adapting the printing process to a different length of the print section without moving the offset roller to a different position. The printing process is initiated at a later point in accordance with the change of length of the section to be imprinted. In this way, the offset roller can actually be omitted.

Further features and advantages of the invention will become apparent from the following description of a particular embodiment of the invention on the basis of the accompanying drawings.

BRIEF DESCRIPTION OF THE DRAWINGS

The sole FIGURE shows schematically the arrangement of the printing apparatus according to the invention.

DESCRIPTION OF A PREFERRED EMBODIMENT

In a printing apparatus as shown schematically in FIG. 1, foil 1 to be imprinted is unrolled from a foil roll 8 and moves through a printing device 2. After the printing device 2, the foil 1, which generally consists of aluminum enters a buffer arrangement including a compensation roller 6 and an offset roller 11. A first redirecting roller 15 is disposed at the exit of the buffer arrangement; a second redirecting roller 17 is arranged at the entrance to the buffer arrangement. After leaving the printing device, the foil moves around the second redirecting roller 17 and the compensation roller 6 around which it forms a loop and is then again redirected around the offset roller 11 forming an S-shaped path. The compensating roller 6 and the offset roller 1 are disposed in opposite loops formed by the foil 1. After the off-set roller 11, the foil 1 extends around the first redirecting roller 15.

After the first redirecting roller 15, there is a section removal device 10, which discontinuously removes foil from the apparatus, and a separating device 4. The removal device 10 is standard equipment, which repeatedly engages part of the foil and moves it out of the apparatus by a pivot arm movement. The separating device 4 may cut the foil into the sections of the length L. In any case, it determines the beginning of a section to be imprinted. The printing process of the printing device 2 depends on, that is, it is controlled by, a section limit as provided by the separating device 4.

The compensation roller 6 and the offset roller 11 are so arranged that they are movable toward, and away from, each other. While the offset roller 11 is lockable in its position, the compensation roller 6 is freely movable. The compensation roller 6 and the offset roller 11 consequently form a buffer arrangement of the foil 1. By adjusting the position of the offset roller 11, the length of the foil 1 between the separating device 4 and the printing device 2 can be adjusted. This is necessary when the predetermined length L of the foil sections is changed.

The first redirecting roller 15 is provided with a first rotation sensor 5 providing a signal proportional to the rotational movement of the redirecting roller 15. The second redirecting roller 17 is provided with a second rotation sensor 7 providing a signal proportional to the rotational movement of the redirecting roller 17.

Adjacent the path of movement of the compensation roller 6, there is an optical sensor 3 so arranged that it provides an output signal change when the length of the foil 1 between the separating device T and the printing device 2 is a predetermined multiple of the predetermined length L.

During the time in which the foil removal device 10 is in a rest position for engaging a new foil section, no foil is taken out of the apparatus. However, the foil 1 is continuously moved through the printing device 2 so that the length of the foil 1 between the separating device 4 and the printing device 2 increases during that time. To accommodate the excess foil length, the compensation roller 6 moves downwardly until the foil removal device 10 resumes its foil removal. In the position as shown in the figure, the compensation roller 6 is about at the point at which the removal device 10 resumes removal of the foil 1.

The foil removal device removes the foil 1 from the apparatus according to the invention at a speed, which is a multiple of the speed with which the foil 1 moves through the printing device 2. Since, at this point, more foil 1 is removed from the apparatus than is supplied by the printing device 2, the length of the foil 1 between the separating device 4 and the printing device 2 becomes shorter so that the compensation roller 6 moves upwardly.

At the instant when the compensation roller 6 is disposed adjacent the optical sensor 3, the optical sensor 3 provides an output signal by way of its output 3*a*. This signal is supplied to the input 2*a* of the printing device 2. At this point, the length of the foil 1 between the separating device 4 and the beginning of a section to be imprinted is for example, ten times the length of a section to be imprinted. Since the printing device receives a printing initiation signal at exactly this point in time, the printing image is accurately imprinted onto a foil section. Obviously, any distance dependent on the type of printing device such as an empty portion of the circumference of a printing roller between the ends of an image on the printing roller and the location of the image on the foil must be taken into consideration for example by an adjustment of the offset roller position.

The output of the second rotation sensor 7, the output of the first rotation sensor 5 and the output of the compensation roller position sensor 3 are connected to a control unit 12 including a computer which determines the average value of the signal provided by the first rotation sensor 5 and forms the difference between the signal of the second rotation sensor 7 and the average value of the signal of the first rotation sensor 5. A first output line of the control unit 12 includes a delay member 13, which is connected to the input 2*a* of the printing device 2 for initiating the printing process. With the delay member 13, the signal initiating the printing process can be delayed whereby the distance of a printing image from the beginning of a section to be imprinted can be adjusted.

A second output line of the control unit 12 is connected to another input 2*b* of the printing device 2 for controlling the speed with which the foil 1 is moved through the printing device 2. The signal provided by the control unit 12 to the other input 2*b* of the printing device 2 corresponds to the average value of the signal generated by the first rotation sensor 5. As a result, the speed with which the endless foils 1 is moved through the printing device is exactly the average speed with which the foil 1 is removed from the apparatus by the foil section removal device 10.

Since the signal provided by the second rotation sensor 7 corresponds to the actual speed with which the endless foil is moved through the printing device 2 the signal can be used by the control unit 12 for maintaining the speed of the printing device constant.

The difference between the output signals of the two rotation sensor 5, 7 formed by the control unit 12 is a measure for the length of the foil 1 within the buffer arrangement. In order for the oscillating movement of the compensation roller 6 around the location of the sensor 3 to be the same in both directions, there must be a certain length of the endless foil 1 within the buffer arrangement. Since it is advantageous for an accurate positioning of the image on the foil 1 if the oscillations of the compensation roller 6 around the sensor 3 are the same in both directions, the signal supplied by the control unit 12 to the input 2*b* of the printing device 2 is so adjusted that the length of the foil in the buffer arrangement corresponds to the certain length.

Below, the operation of the apparatus according to the invention will be described.

By means of the removal device 10, the foil 1 is discontinuously removed from the apparatus according the invention. The first rotation sensor 5 accordingly generates groups of impulses. The impulse groups are supplied to the control unit 12, which forms an average value therefrom. The average value is supplied to the input 2*b* of the printing device, whereby the foil movement speed through the printing device 2 corresponds to the average speed at which the foil removal device removes the foil 1 from the printing apparatus according to the invention.

If the second rotation sensor 7 senses a deviation from that is a speed which is lower than the predetermined speed, the control unit 12 increases the signal supplied to the additional connection 2*b* of the printing unit 2 so that again the same amount of foil 1 is supplied to the buffer arrangement as is removed therefrom on average by the removal device 10.

As a result of the discontinuous removal of foil by the removal device 10, the compensating roller 6 is subjected to an oscillating movement. The compensating roller position sensor 3 is so arranged that it is disposed in the center of the path of movement of the compensation roller 6. In this way, the distances of the compensation roller 6 from the sensor at the reversal points of the compensation roller are the same. If, because of some error, more of the foil 1 is supplied to the buffer arrangement than is removed therefrom the center position of the compensating roller moves downwardly. The sensor 3 is then no longer adjacent the center position.

With the supply of an excess amount of foil 1 to the buffer arrangement, the difference between the output signals of the two rotation sensors 5 and 7 which is formed in the control unit 12 has also changed. In accordance with this change, the control unit 12 corrects the signal supplied to the additional input 2*b* of the printing device 2 in such a way that the original difference is re-established, that is, so that the sensor 3 is again in the center of the oscillation movement of the compensation roller 6.

Since, with any change of the speed at which foil is removed from the apparatus, more or less foil is removed from the buffer arrangement than is supplied thereto, the center point about which the compensation roller 6 oscillates also changes.

This change is corrected in the same manner as the center position of the oscillating compensation roller is changed because of another error. Consequently, by forming the difference between the signals of the two rotation sensors 5, 7, the optimal position of the compensation roller 6 can be automatically re-established when the speed changes, at which foil is removed from the apparatus.

At the moment when the compensation roller 6 is disposed adjacent the sensor 3, the signal at the output of the sensor 3 changes. The signal change is supplied to the control unit 12, which supplies a corresponding signal to the delay unit 13. If the imprint should not be corrected, the signal is supplied to the input 2*a* of the printing device 2 without any delays to initiate the printing step.

Although the compensation roller position sensor 3 used in the embodiment disclosed herein is an optical sensor, another type of sensor such as a so-called electronic scale may be used. Instead of a signal change, the control unit 12 then would need to evaluate a distance signal. With such an electronic scale, the need for a mechanical adjustment of the sensor 3 could be avoided since the adjustment could be made by changing the distance value provided by the scale or changing the calculation value. In this way, the offset roller 11 could be omitted since the length change of the foil 1 to be made by the offset roller can be taken into consideration by the control unit.

What is claimed is:

1. An apparatus for imprinting an unmarked foil with images which are arranged within sections of the foil of a predetermined length, comprising a printing device through which said foil moves continuously and in which images are imprinted centered on said foil sections, a transport device receiving said foil for transporting said foil in steps of said predetermined length, a cutting device arranged adjacent said transport device for cutting said foil into said sections of said predetermined length, a control unit, a buffer arrangement having an entrance and an exit and being disposed between said printing device and said transport device and including a first foil motion sensor at the exit of said buffer arrangement and a foil length sensor providing a signal to said control unit when the length of the foil between its end in the cutting device and the printing device is a predetermined multiple of said predetermined length, said first foil motion sensor at the exit of said buffer arrangement generating a varying foil motion signal which depends on the discontinuous motion of said transport device which signal is averaged in said control unit to represent the average speed with which said foil leaves said buffer arrangement, and the averaged signal is applied to said printing device so as to operate said printing device at the same average speed at which the foil leaves the buffer arrangement.

2. An apparatus according to claim 1, wherein said buffer arrangement includes a compensation roller around which said foil extends so as to form a loop and which is movably supported such that its position depends on the length of the foil between the end of the foil at said cutting device and said printing device, said foil length sensor being positioned so as to sense the location of said compensation roller.

3. An apparatus according to claim 2, wherein said buffer arrangement includes an offset roller around which said foil extends and whose position is adjustable for controlling length of said foil between said cutting device and said printing device.

4. An apparatus according to claim 2, wherein said foil length sensor is a compensating roller position sensor and said compensating roller position sensor is arranged so as to provide a signal when the length of said foil between said cutting device and said printing device is a predetermined multiple of said predetermined length of a section of said foil on which an image is to be imprinted.

5. An apparatus according to claim 1, wherein a second foil motion sensor is arranged at the entrance to said buffer arrangement for providing a signal to said control unit indicative of the speed and foil length leaving said printing device and entering said buffer arrangement, said control unit comparing the signals from said first and second foil motion sensors for controlling the speed of said printing device.

6. An apparatus according to claim 5, wherein said control unit determines the difference between said first and second foil motion sensor signals for correcting initiation of the operation of said printing device.

* * * * *